US008313174B2

(12) United States Patent
Stevenson et al.

(10) Patent No.: US 8,313,174 B2
(45) Date of Patent: Nov. 20, 2012

(54) METHOD FOR REDUCING MECHANICAL CROSS-TALK BETWEEN ARRAY STRUCTURES ON A SUBSTRATE MOUNTED TO ANOTHER SUBSTRATE BY AN ADHESIVE

(75) Inventors: James Maxwell Stevenson, Tualatin, OR (US); Lisa Marie Schmidt, Sherwood, OR (US); Jeffrey Thomas Flynn, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 1006 days.

(21) Appl. No.: 12/186,751

(22) Filed: Aug. 6, 2008

(65) Prior Publication Data

US 2010/0033541 A1 Feb. 11, 2010

(51) Int. Cl.
*B41J 2/045* (2006.01)

(52) U.S. Cl. ..... 347/70

(58) Field of Classification Search ..... 347/70
See application file for complete search history.

(56) References Cited

U.S. PATENT DOCUMENTS 4,587,528 A 5/1986 Beaudet
5,922,218 A 7/1999 Miyata et al.
5,997,134 A 12/1999 Hotomi et al.
6,037,707 A 3/2000 Gailus et al.
6,176,570 B1 * 1/2001 Kishima et al. ..... 347/70
6,332,672 B1 12/2001 Yazaki et al.
6,437,487 B1 8/2002 Mohr, III et al.
6,688,731 B1 2/2004 Fujii et al.
6,931,702 B2 8/2005 Mitsuhashi et al.
7,108,360 B2 9/2006 Lu et al.
7,168,791 B2 1/2007 Hoisington et al.
7,196,456 B2 3/2007 Nakano et al.
7,290,336 B2 11/2007 Buhler et al.
7,388,319 B2 6/2008 Bibl et al.

* cited by examiner

*Primary Examiner* — Jerry Rahll

(74) *Attorney, Agent, or Firm* — Maginot, Moore & Beck, LLP

(57) ABSTRACT

A method binds a substrate having an array of actuators to a diaphragm array in a way that reduces secondary banding in an ink jet printhead that ejects a different color ink from each row of ink jets in the printhead. The method includes cutting a plurality of horizontal channels in a substrate on which a plurality of actuators have been formed, the horizontal channels being cut between rows of actuators on the substrate, and cutting a plurality of vertical channels in the substrate on which the plurality of actuators have been formed, the vertical channels being cut between columns of actuators on the substrate, the vertical channels having a width that is less than a width of the horizontal channels.

5 Claims, 4 Drawing Sheets

METHOD FOR REDUCING MECHANICAL CROSS-TALK BETWEEN ARRAY STRUCTURES ON A SUBSTRATE MOUNTED TO ANOTHER SUBSTRATE BY AN ADHESIVE

TECHNICAL FIELD

This disclosure relates generally to the binding of substrates to one another in a multi-layer device and, more particularly, to the binding of an array of actuators on an array to a diaphragm layer in an ink jet printhead.

BACKGROUND

Modern printers use a variety of inks to generate images from data. These inks may include liquid ink, dry ink, also known as toner, and solid ink. In liquid ink jet printers, the liquid ink is typically stored in cartridges, which are installed in the printers, and delivered to a print head. Solid ink printers, however, are loaded with blocks or pellets of solid ink that are transported to a melting device where the solid ink is heated to a melting temperature. The melted ink is collected and delivered to a printhead.

In both liquid ink and solid ink printers, the liquid ink is provided to a printhead and selectively ejected onto media, such as paper, advancing past the printhead, or onto a rotating offset member. In offset printing machines, the image generated on the rotating offset member is transferred to media by synchronizing passage of media and rotation of the image on the member into a transfer nip formed between a transfix roller and the offset member. The printheads for liquid ink and solid ink printers typically include a plurality of ink jet stacks that are arranged in a matrix within the printhead. Each ink jet stack has a nozzle from which ink is ejected by applying an electrical driving signal to an actuator in the ink jet stack to generate a pressure pulse that expels ink from a reservoir in the ink jet stack.

A partially assembled ink jet stack is shown in a cross-sectional side view in FIG. 4. The ink jet stack 10 includes a nozzle plate 14, an inlet plate 18, a body plate 22, and a diaphragm plate 26. These plates are assembled and bonded to one another using adhesives in a known manner to form ink jet stack 10. The nozzle plate 10 includes a plurality of openings 30, which act as nozzles for ink expelled from ink supplies 34. Ink enters the ink supplies 34 through inlets 38. The diaphragm plate 26 is made of a resilient, flexible material, such as stainless steel, so the plate can move back and forth to expel ink in one direction of movement and to induce movement of ink into the supplies 34 in the other direction of movement. Movement is actuated by the reaction of the actuator 42, to the input of electrical energy provided through conductive adhesive 46 and an electrical contact pad 50. The electrical contact pad 50 is mounted to a support member 54, such as a flex cable or an electrical circuit board (ECB), which is partially supported by standoffs 58, which are also mounted to the support member 54. The actuator may be a piezoelectric material, such as lead-zirconium-titanate, which is sandwiched between two electrodes. An electrical signal generated by a printhead controller is conducted by an electrical lead to the electrical contact pad 50 and then through the conductive adhesive to the electrode contacting the adhesive. The charge on the electrode results in an electric field between the two electrodes on opposite sides of the actuator material. The direction and strength of this electric field induces the piezoelectric material to deflect in one direction or another to either expel ink from the ink supply or to induce ink to enter the ink supply through the ink inlet.

The actuators 42 are arranged in an array on a substrate 400 as shown in FIG. 5. Horizontal channels 408 and vertical channels 410 are cut into the substrate 400 to isolate the actuators 42 from one another mechanically. Adhesive is applied to the diaphragm layer 26 at positions that corresponds to locations the actuators touch after the two substrates are mounted together. The diaphragm layer 26 and the actuator substrate 400 are pressed into contact with one another to bind the two layers together. This assembly enables the deflection of the actuators to move the diaphragm layer, which is immediately adjacent to the ink supply area.

In some ink jet heads, each row of actuators is coupled to ink supply areas having a different color of ink. A phenomena known as secondary banding has been observed in these printheads. Secondary banding occurs when mechanical jitter causes the ejected ink to land at non-uniform intervals on the imaging material. As a consequence, the printing of secondary colors, which requires two colors of ink to be printed on top of one another, may produce inconsistent results. A uniformly generated secondary color is shown in FIG. 6, while secondary banding is shown in FIG. 7. Attenuation of the inconsistent ejection of the ink that produces secondary banding is desirable.

SUMMARY

A method binds a substrate having an array of actuators to a diaphragm array in a way that reduces secondary banding in an ink jet printhead that ejects a different color ink from each row of ink jets in the printhead. The method includes cutting a plurality of horizontal channels in a substrate on which a plurality of actuators have been formed, the horizontal channels being cut between rows of actuators on the substrate, and cutting a plurality of vertical channels in the substrate on which the plurality of actuators have been formed, the vertical channels being cut between columns of actuators on the substrate, the vertical channels having a width that is less than a width of the horizontal channels.

The method may be used to construct an ink jet printhead that is less likely to generate secondary banding. The ink jet printhead includes a diaphragm layer that overlies a plurality of ink supply areas, and an actuator substrate on which a plurality of actuators have been formed and arranged in an array having rows and columns of actuators, the actuator substrate having a plurality of horizontal channels between the rows of actuators on the substrate, and a plurality of vertical channels between the columns of actuators on the substrate, the vertical channels having a width that is less than a width of the horizontal channels.

BRIEF DESCRIPTION OF THE DRAWINGS

The foregoing aspects and other features of a method for mounting a diaphragm layer to a substrate on which a plurality of ink jet actuators have been formed and the ink jet printhead produced by such a method are explained in the following description, taken in connection with the accompanying drawings.

DETAILED DESCRIPTION

Figure 1:
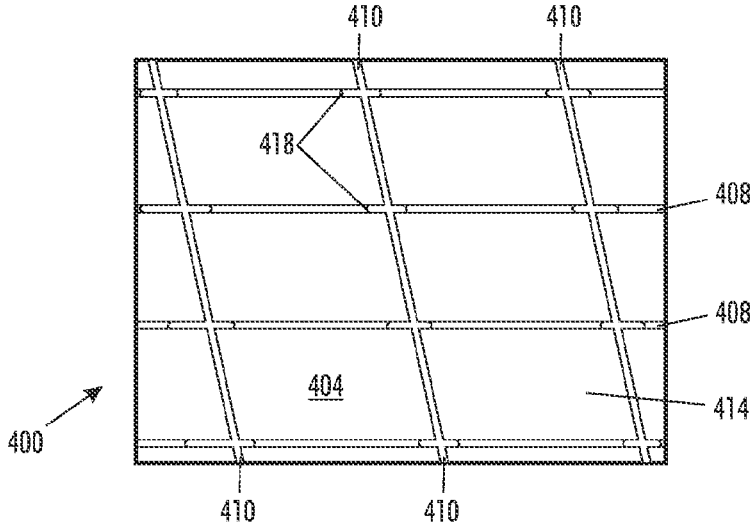
FIG. 1 is a view of channels between actuators in an array of actuators on a substrate in which the epoxy used to mount the substrate to a diaphragm layer has seeped into the horizontal channels between rows of the actuators.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, etc.

FIG. 1 depicts the substrate 400 on which an array of actuators 404 have been formed. In this previously known configuration, the horizontal channels 408 between the rows of the actuators are narrower than the vertical channels 410 between the columns of the actuators. An adhesive 414, such as epoxy, is applied to either a surface of the diaphragm layer that faces the substrate 400 or to a surface of the substrate 400 that faces the diaphragm layer. In response to the two layers being pressed together, the epoxy fills the voids between the surface of the diaphragm layer and the substrate 400, but some of the epoxy also fills a portion 418 of the horizontal channels between the rows of actuators. The epoxy between the rows has been determined as providing a mechanical linkage between actuators on different rows of the actuator array. This linkage is thought to cause instability in the ink jets on different rows and this instability leads to secondary banding during printing operations with printheads having such substrates. Although FIG. 1 shows the epoxy in the horizontal channels at the intersections of the vertical channels and horizontal channels, epoxy more frequently enters the horizontal channels at other portions of the horizontal channels. Therefore, reducing the filling of the horizontal channels at any position of the horizontal channels is a worthwhile goal.

Figure 2:
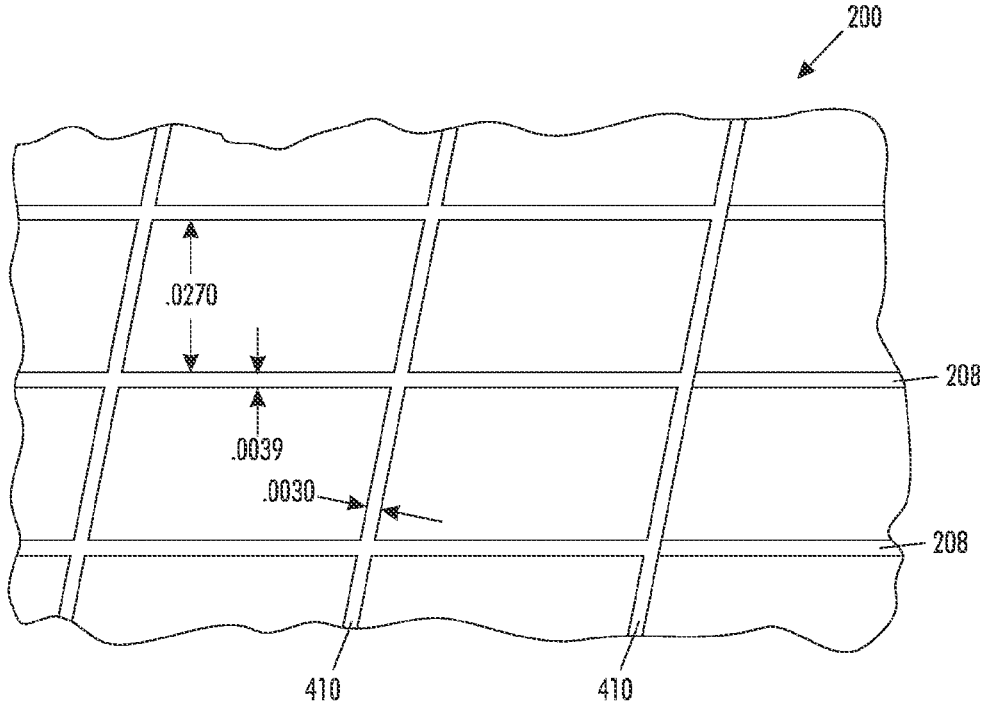
FIG. 2 is a plan view of a substrate on which a plurality of ink jet actuators have been formed with a grid of horizontal and vertical channels that are configure to reduce the amount of epoxy entering the horizontal channels between rows of actuators.
Figure 4:
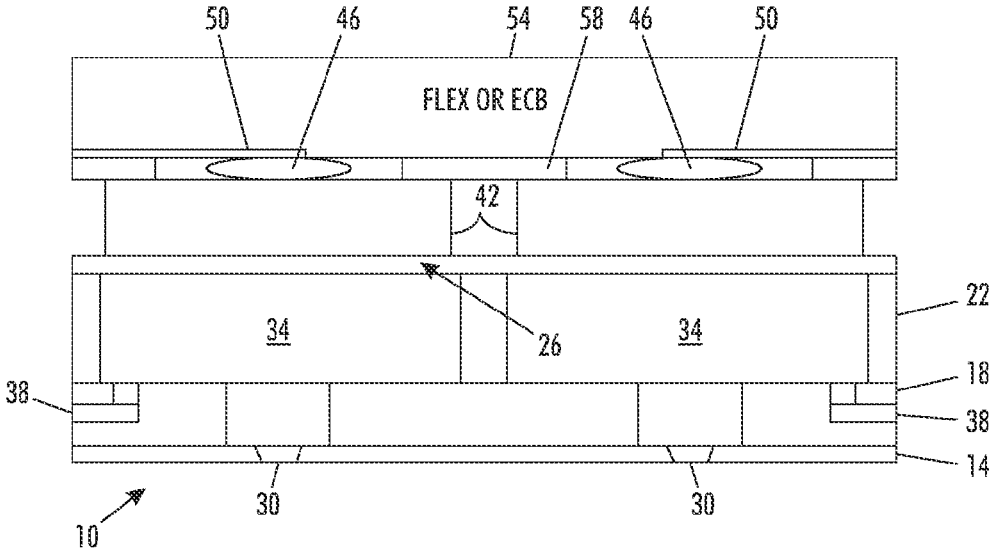
FIG. 4 PRIOR ART
FIG. 4 is a view of a partially assembled ink jet printhead having a diaphragm layer and a substrate to which a plurality of actuators have been formed.
Figure 5:
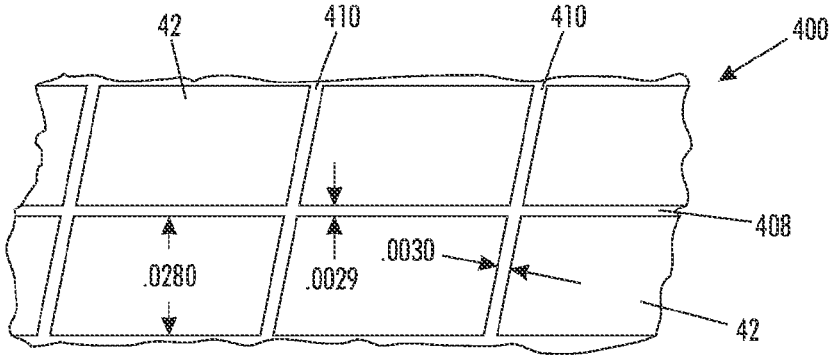
FIG. 5 PRIOR ART
FIG. 5 is a plan view of the substrate on which an array of actuators has been formed that is assembled with the diaphragm layer of the ink jet printhead shown in FIG. 4.
Figure 6:
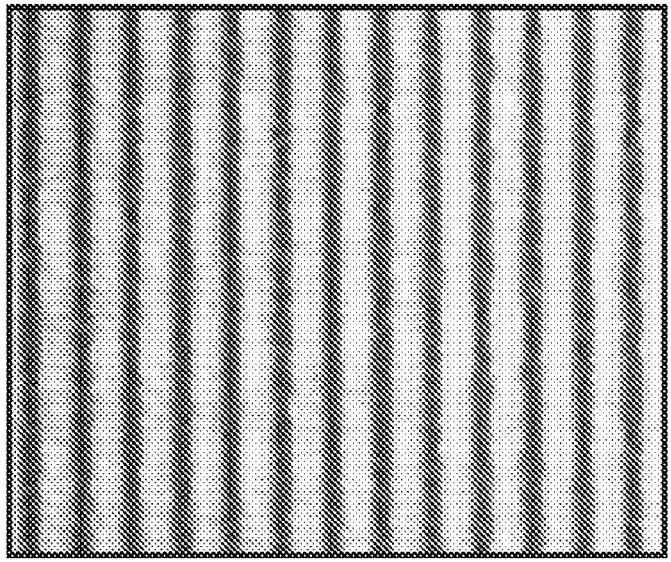
FIG. 6 is a view of printing of secondary colors by an ink jet printhead that uniformly ejects ink from each row of actuators in the printhead.
Figure 7:
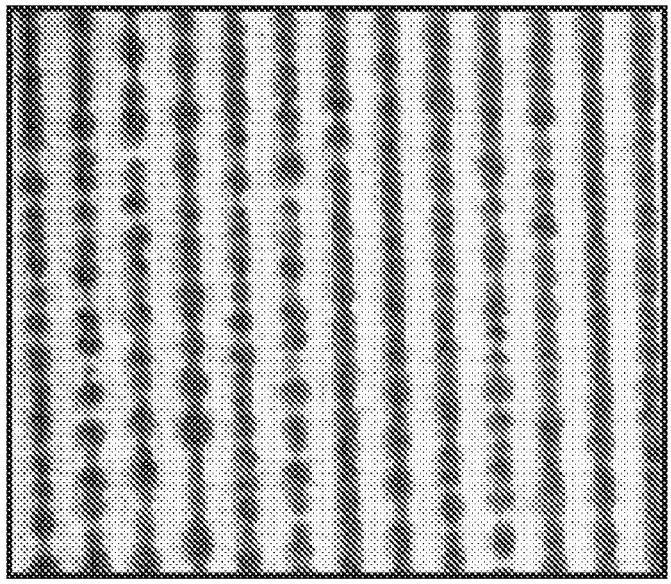
FIG. 7 is a view of printing of secondary colors by an ink jet printhead that does not uniformly eject ink from each row of actuators in the printhead.

In order to reduce substantially the amount of epoxy entering the horizontal channels between the actuator rows, the horizontal channels 208 on the substrate 200 shown in FIG. 2 have been widen without altering the dimensions of the channels 410. In one embodiment of the substrate, the horizontal channels 208 have a width of 3.9 mils, while the vertical channels 410 have a width of 3.0 mils. In the previously known substrate 400 of FIG. 4, the horizontal channels 408 have a width of 2.9 mils and the vertical channels 410 have a width of 3.0 mils. The change in the horizontal channel width results in most all of the epoxy remaining in the vertical channels. The printheads having a substrate like the one shown in FIG. 2 do not exhibit the secondary banding thought to arise from the epoxy filling the horizontal channels of the substrate 400 in FIG. 4. The aspect ratio of the length of each actuator to its width is nominally affected by the encroachment of the horizontal channel expansion into the actuator and actuator performance is not appreciably altered by the change in the channel geometry.

Figure 3:
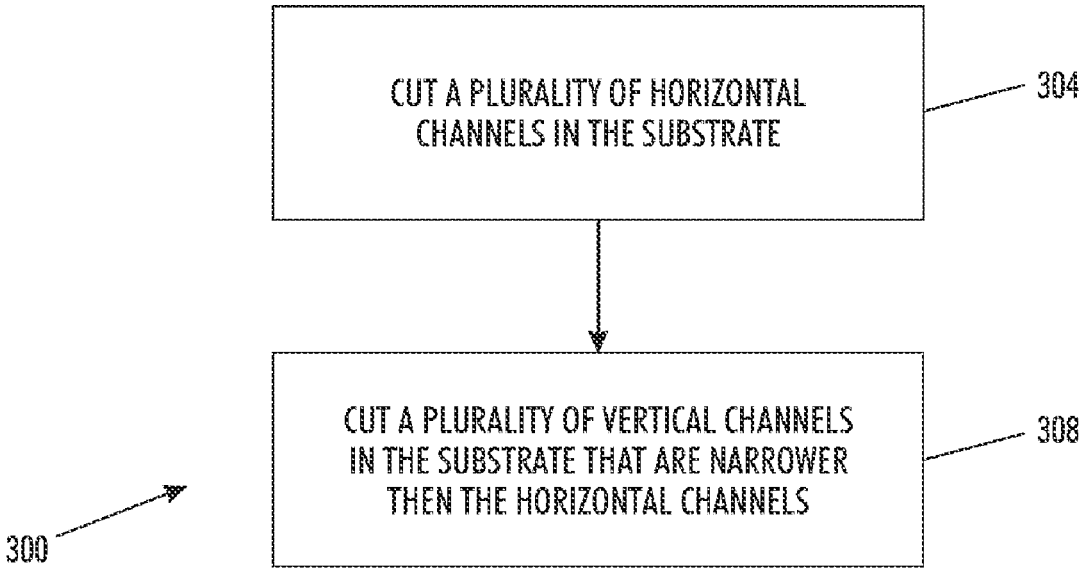
FIG. 3 is a flow diagram of a process for cutting the channels in the substrate of FIG. 1.

A method that provides a configuration of channels between actuators in an array of actuators on a substrate that substantially reduces the amount of epoxy in the horizontal channels is shown in FIG. 3. The method 300 begins with cutting a plurality of horizontal channels in a substrate on which a plurality of actuators have been formed, the horizontal channels being cut between rows of actuators on the substrate (block 304). A plurality of vertical channels is also cut in the substrate on which the plurality of actuators has been formed (block 308). The vertical channels are cut between the columns of actuators on the substrate and the vertical channels have a width that is less than a width of the horizontal channels.

In one embodiment of this method, the cutting is performed with a wet dicing saw process, although other known sawing processes may be used. Alternatively, the channels may be cut with a laser. For example, an image-wise laser ablation method may be used to cut the channels in the substrate having the array of actuators. The laser may be an excimer laser, such as a carbon dioxide laser, although other types of lasers and laser control systems may be used to cut the channels.

The methods disclosed herein may be implemented by a processor being configured with instructions and related circuitry to control the operations of a laser ablation system in an image-wise manner. Additionally, the processor instructions may be stored on computer readable medium so they may accessed and executed by a computer processor to perform the methods for controlling a laser to ablate support member material from an area between the laser and an electrical contact pad that is electrically coupled to an actuator.

While the configuration of channels were discussed above with reference to the binding of an actuator substrate to a diaphragm layer in an ink jet printhead, the method may be used in other applications in which two surfaces are bound to one another about displaceable elements arranged on the substrates. By configuring the vertical channels to have a narrower width about components on a substrate, the epoxy used to bind the two substrates to one another is encouraged to remain in the vertical channels. The reduction of epoxy in the horizontal channels is thought to reduce the mechanical coupling of displaceable components moving on one row and inducing movement in components on another row. While the configuration described above was obtained by increasing the horizontal channel width while holding the vertical channel width steady, the configuration may also be obtained by decreasing the vertical channel width and holding the horizontal channel width steady. Likewise, a combination of increasing the horizontal channel width and decreasing the vertical channel width may also be used.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink jet printhead comprising:

a diaphragm layer that overlies a plurality of ink supply areas; and an actuator substrate on which a plurality of actuators have been formed, each actuator having two sides that are parallel to one another and longer than two other parallel sides of the actuator, the actuator substrate having a plurality of horizontal channels, each horizontal channel being positioned between the longer sides of adjacent actuators on the substrate, and a plurality of vertical channels, each vertical channel being positioned between the shorter sides of adjacent actuators on the substrate, the vertical channels between the shorter sides of the actuators having a width that is less than a width of the horizontal channels between the longer sides of the actuators.

2. The printhead of claim 1 wherein the vertical channels have a width that is less than the width of the horizontal channels by a distance that is less than 1 mil.

3. The printhead of claim 1 wherein the vertical channels have a width that is less than the width of the horizontal channels by a distance that is equal to or greater than 1 mil.

4. The printhead of claim 1 wherein the actuator includes piezoelectric material.

5. The printhead of claim 4 wherein the piezoelectric material is lead zirconium titanate.

* * * * *